United States Patent [19]

Harris

[11] Patent Number: 4,949,901

[45] Date of Patent: Aug. 21, 1990

[54] SELF-LOCKING BILL ACCUMULATOR

[75] Inventor: Robert R. Harris, Schaumburg, Ill.

[73] Assignee: Jerome Remien Corporation, Skokie, Ill.

[21] Appl. No.: 350,306

[22] Filed: May 11, 1989

[51] Int. Cl.[5] ..... G07B 15/00

[52] U.S. Cl. ..... 232/15; 232/1 D; 232/16

[58] Field of Search ..... 232/15, 16, 31, 32, 232/1 D

[56] References Cited

U.S. PATENT DOCUMENTS

| | | | |
|---|---|---|---|
| 1,411,898 | 4/1922 | Augenbraun . | |
| 1,983,089 | 12/1934 | Knee | 232/15 |
| 2,009,085 | 7/1935 | Jackson | 232/15 |
| 2,783,937 | 3/1957 | Hudson | 232/15 |
| 3,033,442 | 5/1962 | Erlichman | 232/15 |
| 3,653,586 | 4/1972 | Bonneson | 232/43.2 |
| 3,677,641 | 7/1972 | Nitschneider et al. | 232/15 |
| 3,807,627 | 4/1974 | Nitschneider | 232/15 |
| 3,807,628 | 4/1974 | Bock | 232/16 |
| 3,837,566 | 9/1974 | McGough | 232/15 |
| 3,974,961 | 8/1976 | Dominick et al. | 232/16 |
| 4,186,977 | 2/1980 | Gilovich et al. | 232/15 X |
| 4,283,097 | 8/1981 | Lundblad | 232/1 R X |
| 4,434,931 | 3/1984 | Hunt et al. | 232/1 R X |
| 4,877,179 | 10/1989 | Baker et al. | 232/15 X |

*Primary Examiner*—Robert W. Gibson, Jr.

*Attorney, Agent, or Firm*—Willian Brinks Olds Hofer Gilson & Lione

[57] ABSTRACT

A self-locking bill accumulator having tamper-proof features is provided for use with a dollar bill processing machine. During use, the bill accumulator is mounted to a bill processing machine. The accumulator has a double locking feature whereby rotation of an outer lock by means of a key is required in order to detach and remove the bill accumulator from the dollar bill processing machine. This rotation of the outer lock occurs prior to removal of the bill accumulator and causes a corresponding rotation of an inner lock, which in turn positively locks the bill accumulator to protect bills in the accumulator from pilferage after removal. Upon removal of the bill accumulator, the outer lock becomes disengaged from the inner lock such that a separate key is required in order to "unlock" the bill accumulator and remove the bills.

12 Claims, 3 Drawing Sheets

ONE DOLLAR

SELF-LOCKING BILL ACCUMULATOR

FIELD OF THE INVENTION

This invention relates to a self-locking bill accumulator system having tamper-proof features, for use in vending machines.

BACKGROUND AND SUMMARY OF THE INVENTION

Security devices and systems for use in coin-operating vending machines are well known in the art. Typically, these devices have the ability to accept a variety of different coin sizes and are adaptable to a wide variety of coin-operated vending machines. Examples of these security devices and systems are disclosed in U.S. Pat. Nos. 4,267,962 and 4,291,831. In both cases, coins are deposited into a vending machine and a selection of merchandise is made. The coins pass through a series of stations in the machine which totalize and register a credit for merchandise. The coins then pass into the security device which, in both cases, includes an upper inlet portion and a lower coin storage bag.

The upper inlet portion in each case includes generally an inlet slot and two locking mechanisms. A first locking mechanism is used for locking the inlet portion of the security device into a receiving position on the vending machine. A second locking mechanism is used for locking the coin storage bag into a receiving position on the inlet portion. The first locking mechanism is engaged by a first key. When the key is turned in order to remove the security device from the vending machine, there is a corresponding movement of an internal closure mechanism which operates to block off the inlet slot. Thereafter, between the time the security device is removed from the vending machine and the time it reaches headquarters for emptying, it is not possible to either insert coins or remove coins from the security device. The coins contained in the security device are thereby protected from pilferage during transportation of the device.

Once the security device reaches headquarters, a second key is engaged to the second locking mechanism in order to separate the coin storage bag from the upper inlet portion, whereby the bag can be emptied and replaced.

As the prices of vending machine merchandise have risen, vending machines which accept bills in place of or in addition to coins have become increasingly popular. Accordingly, there is a need for a bill accumulating system which protects dollar bills from pilferage during transportation of the bill accumulating device. As with the security devices previously used for coins, the bill device must be lightweight and durable, and must be adaptable to a wide variety of vending machines.

Accordingly, the present invention provides a self-locking bill accumulator system which meets the foregoing requirements. The device in accordance with the invention will freely accept a large volume of bills and can be used to collect bills of different denominations. Furthermore, the device is reliable and durable, and can be constructed from relatively inexpensive and lightweight materials.

DETAILED DESCRIPTION OF A PREFERRED EMBODIMENT

Figure 3:
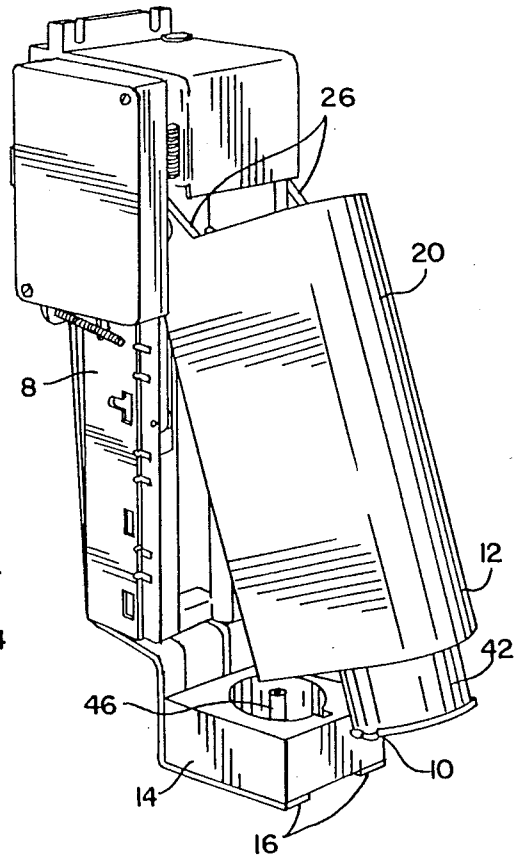
FIG. 3 shows the bill accumulating portion as it is being removed from the bill validator. The outer locking mechanism remains mounted to the bill validator as shown.
Figure 2:
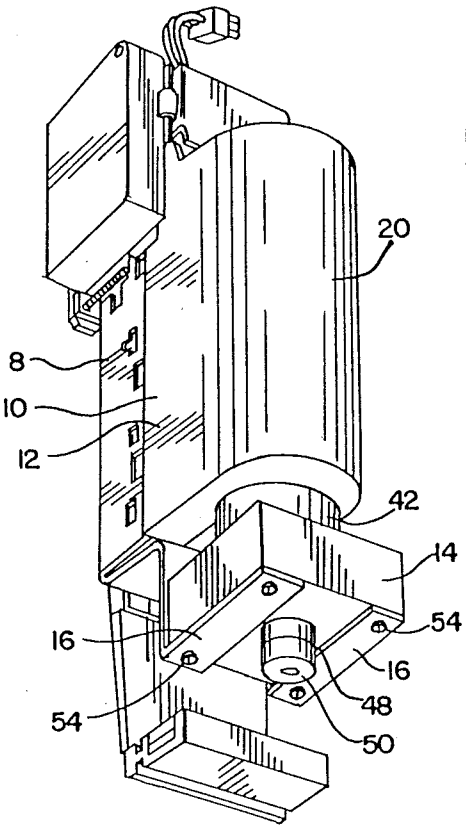
FIGS. 1 and 2 illustrate the bill accumulator of the invention in its operational position for receiving bills, mounted onto a bill validator.
Figure 1:
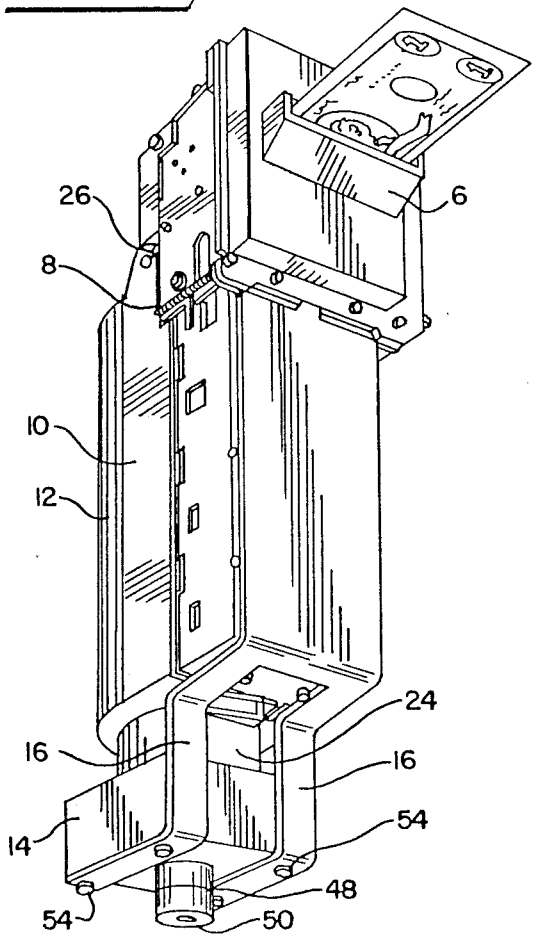

Referring to FIGS. 1–3, a bill accumulator system 10 of the invention is provided for mounting onto a bill validator 8 which in turn is mounted onto the inside of a vending machine or other bill processing machine (not shown). The bill accumulator system 10 includes a bill accumulating portion 12 which can be removed from the bill validator 8, and an outer mounting member 14 which remains permanently secured to the mounting brackets 16 extending from the bill validator 8.

Figure 6:
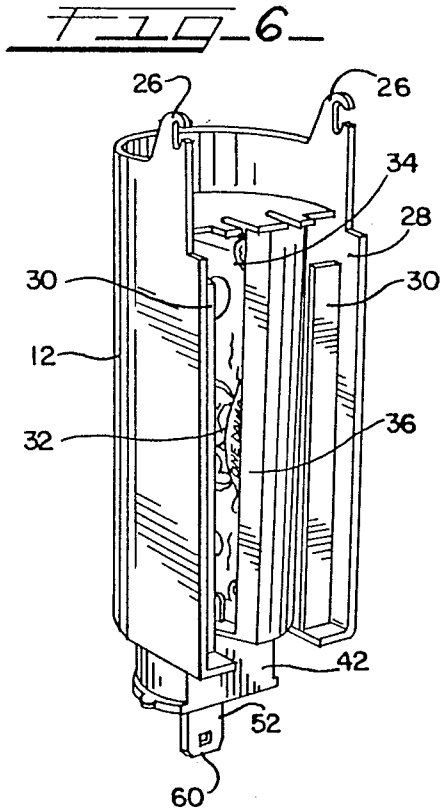
FIGS. 6 and 7 illustrate the use of a second key inserted the, inner locking mechanism to reopen the bill accumulating portion to allow removal of the bills therein.
Figure 5:
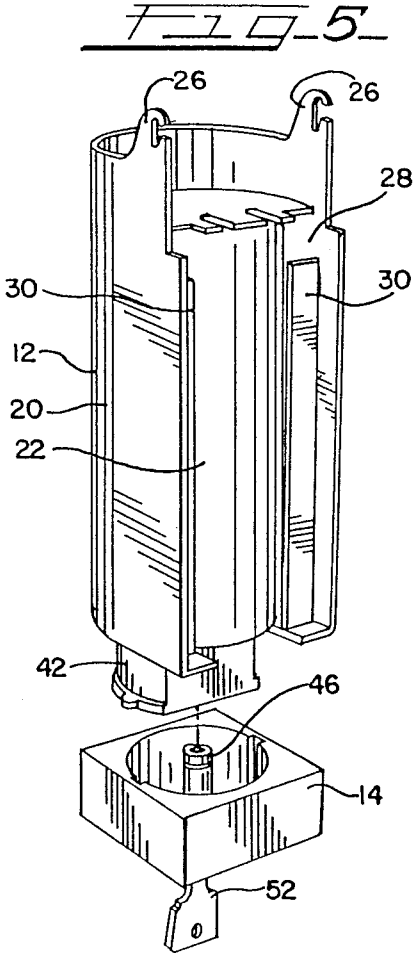
FIG. 5 shows a bill accumulator of the invention in which the outer locking mechanism has been detached from the inner locking mechanism by turning the key as shown. The turning of the key also causes the bill accumulator to lock into the closed position shown.
Figure 4:
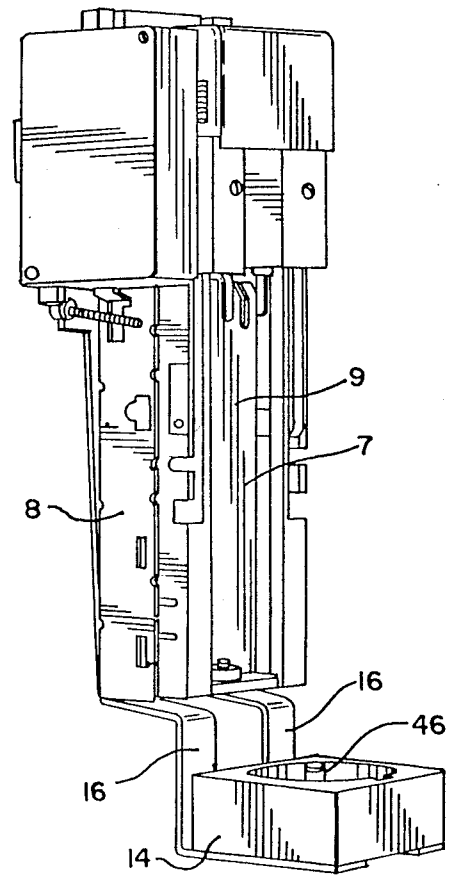
FIG. 4 shows a bill validator after the bill accumulator of the invention, has been removed, except for the outer locking mechanism.
Figures 7, 8, 9, 10, 11:
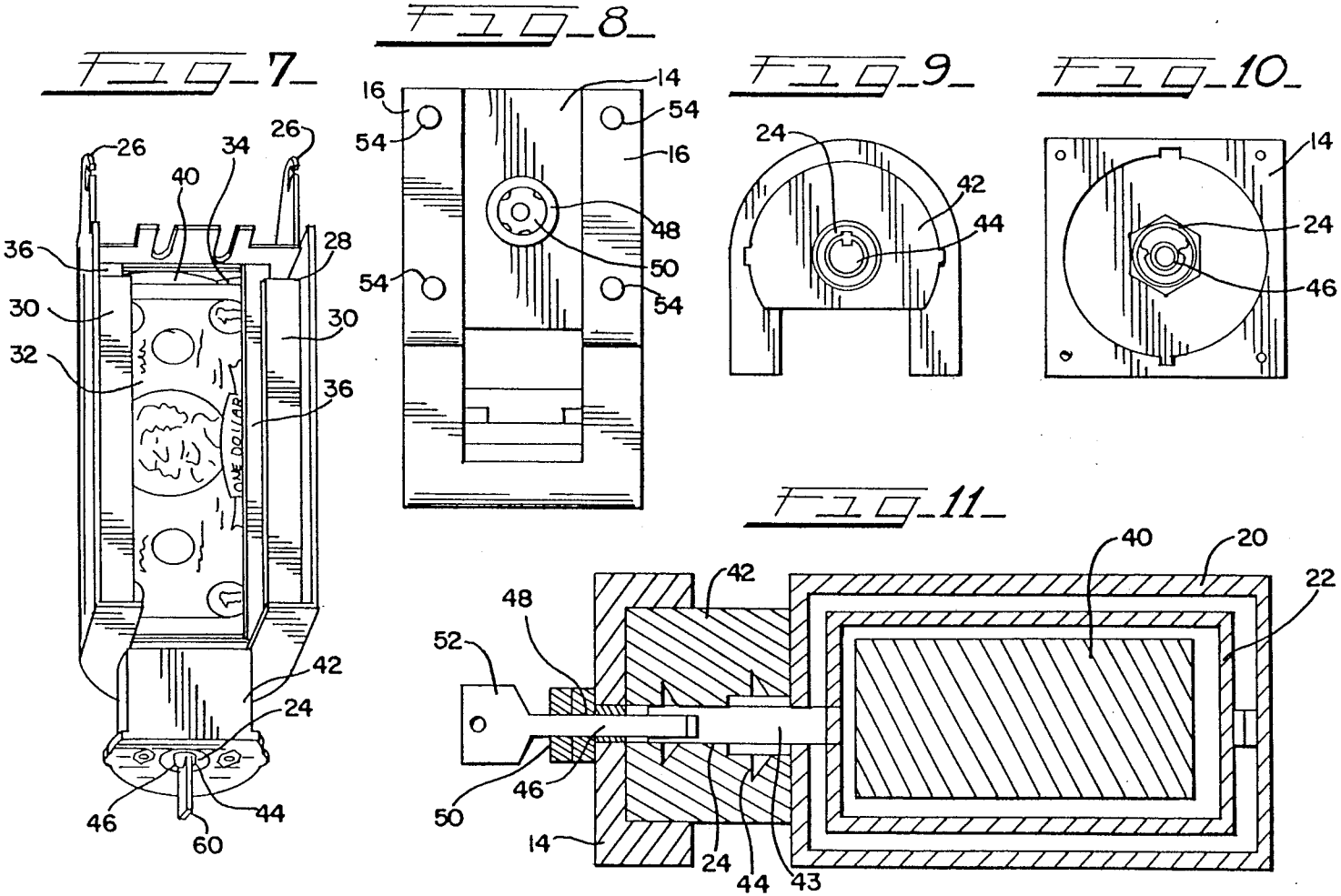
FIG. 8 an outside view of the mounting member for the outer locking mechanism shown in FIG. 4.
FIG. 9 is an end view of the bill accumulating portion of the bill accumulator of the invention, the inner locking mechanism.
FIG. 10 is an inside end view of the outer locking mechanism and mounting member shown in FIGS. 4 and 5.
FIG. 11 a sectional view of the bill accumulator of the invention, showing in detail how the actuating mechanisms interconnect with one another.

Referring now to FIGS. 5–7, the bill accumulating portion 12 includes an outer housing 20, an inner housing 22 rotatably mounted to the inside of the outer housing 20, and a first actuating mechanism 24 mounted to the outer housing 20 and connected to the inner housing 22, for rotating the inner housing 22 relative to the outer housing 20. The outer housing 20 includes a pair of mounting brackets 26 for mounting the bill accumulating portion 12 onto the bill validator 8, and an open face 28 having two coplanar rectangular edges 30 which define an opening which is slightly narrower and slightly longer than the surface of a dollar bill 32 as shown in FIG. 7.

The inner housing 22 also includes an open face 34 having two coplanar rectangular edges 36 which define an opening which is slightly narrower and slightly longer than the surface of a dollar bill 32 as shown in FIGS. 6 and 7. The outer housing 20 and the inner housing 22 are preferably semi-cylindrical in shape. This facilitates rotation of the inner housing 22 relative to the outer housing 20 between an open position for receiving and storing bills in which the open face 34 of the inner housing 22 corresponds with the open face 28 of the outer housing 20 as shown in FIG. 7, and a closed position for blocking the passage of bills in which the open face 34 of the inner housing 22 points away from the open face 28 of the outer housing 20 as shown in FIG. 6.

During operation, the inner housing 22 is in the open position such that the open face 34 of the inner housing 22 and the open face 28 of the outer housing 20 both face the bill validator 8. When a bill is inserted into the slot 6 shown in FIG. 1, it is first validated and is then passed into a long and narrow section 7 of the bill validator 8 whereupon the bill comes to rest with one surface facing the ejector bar 9 of the bill validator 8 and the opposite surface facing the open faces 34 and 28 of the inner and outer housings of the bill accumulator 10. At this point, the ejector bar operates by a mechanism well known in the art to push the bill out of the bill validator, through the open faces 34 and 28, and into the inner housing of the bill accumulator 10.

The bills are maintained in the inner housing in a substantially flat and stacked position by the operation of a substantially flat support surface 40, as shown in FIG. 7, which urges the bills 32 against the inner surfaces of the coplanar edges 36 of the open face 34 of the inner housing 22. The support surface 40 may be an outer surface of a spring-loaded plate mounted inside the inner housing 22, or may alternatively be a substantially flat surface of a foam rubber insert. Other mechanisms for supporting the bills are also possible, so long as the support is sufficient to maintain the bills in a substantially flat stacked configuration.

The first actuating mechanism 24, shown in FIGS. 7 and 9, is mounted to the outer housing 20 by means of a mounting member 42. The first actuating mechanism 24 includes a stud 43 which is engaged to an end of the inner housing 22 as shown in FIG. 11, and includes an inner locking mechanism 44 positioned along the stud 43. When driven by the rotation of a first key stem 46 inserted into the inner locking mechanism 44, the first actuating mechanism 24 effects rotation of the inner housing 22 between two locked positions, an open position as shown in FIG. 7 and a closed position as shown in FIG. 5.

During operation, the first actuating mechanism 24 is engaged by a second actuating mechanism 48 which is mounted by means of a mounting member 14 as shown in FIGS. 1 and 2. The second actuating mechanism 48 includes a first key stem 46 engageable to the inner locking mechanism 44 as shown in FIGS. 3, 5 and 11, and a second locking mechanism 50 which is driven by rotation of a second key 52 between a locked position in which the second actuating mechanism 48 and the first actuating mechanism 24 are locked together, and an unlocked position in which the first actuating mechanism 24 is released from the second actuating mechanism 48.

The rotation of the second key 52 between the locked and unlocked positions effects a corresponding rotation of the first key stem 46 such as to cause rotation of the inner housing 22 between its open and closed positions. Thus, when the second key 52 is rotated such as to cause the second actuating mechanism 48 and the first actuating mechanism 24 to lock together, there is a corresponding rotation of the first key stem 46, causing the inner housing 22 to rotate and to become locked in its open position for the accumulation of bills from the bill validator 8 as shown in FIGS. 1 and 2. Thereafter, when the second key 52 is rotated such as to cause the second actuating mechanism 48 and the first actuating mechanism 24 to become disengaged as shown in FIG. 3, there is a corresponding rotation of the first key stem 46 causing the inner housing 22 to rotate and to become locked in its closed position. There is no way to remove the bill accumulating portion 12 from the bill validator 8 without first locking the inner housing in its closed position, because the movement of the key 52 which is required to disconnect the bill accumulating portion causes a corresponding rotation of the inner housing 22 to its closed and locked position.

Typically, the route man will have in his possession the second key 52 which is required to remove the bill accumulating portion 12 from the bill validator 8. Because the removal exercise also causes a corresponding rotation and locking of the inner housing 22, the route man does not have access to the bills stored in the inner housing 22. The mounting member 14 which contains the second actuating mechanism 48 remains permanently mounted to the brackets 16 which extend from the bill validator 8, such as by the four rivets 54 shown in FIG. 8. Thus, the only time that the second actuating mechanism 48 can be used to reopen the bill accumulating portion 12 is when the bill accumulating portion 12 is reinstalled and locked into place with its open faces 34 and 28 facing the bill validator 8.

When the bill accumulating portion 12 reaches headquarters, a key 60 which has a key stem identical to the key stem 46 of the second actuating mechanism 48, can be used to unlock the inner housing 22 and rotate the inner housing 22 to its open position as shown in FIGS. 6 and 7. The inner housing 22 may then be emptied and closed, and given back to the route man for reinstallation in the bill processing machine.

Although the invention has been described above with a certain degree of particularity, it should be understood that this disclosure has been made only by way of example. Consequently, numerous changes in the details of construction and in the combination and arrangement of the components, as well as in the possible modes of utilization in accordance with this invention will be apparent to those familiar with the art, and may be resorted to without departing from the scope of the invention.

What is claimed is:

1. A bill accumulator system for receiving and storing bills, comprising:

an outer housing having an open face for receiving bills from a bill validator;

an inner housing having an open face for receiving and storing bills inside the inner housing, rotatably mounted inside the outer housing;

first actuating means mounted to at least one of the inner and outer housings for rotating the inner housing relative to the outer housing, comprising an inner locking means for selectively locking the inner housing into an open position for receiving bills in which the open face of the inner housing corresponds to the open face of the outer housing, and a closed position for blocking the passage of bills in which the open face of the inner housing points away from the open face of the outer housing;

second actuating means engageable to the first actuating means for driving the first actuating means, comprising a first key means engageable to the inner locking means and a second locking means for selectively locking the second actuating means to the first actuating means as the inner housing is rotated to its open position, and for releasing the first actuating means from the second actuating means as the inner housing is rotated to its closed position; and means for mounting the bill accumulator system onto a bill validator.

2. The bill accumulator system of claim 1 wherein the open face of the outer housing comprises two coplanar rectangular edges defining an opening which is slightly longer, and slightly narrower, than the surface of a dollar bill.

3. The bill accumulator system of claim 1 wherein the open face of the inner housing comprises two coplanar rectangular edges defining an opening which is slightly longer, and slightly narrower, than the surface of a dollar bill.

4. The bill accumulator system of claim 3 wherein the inner housing comprises means for maintaining bills stored therein in a substantially flat, stacked configuration.

5. The bill accumulator system of claim 4 wherein the means for maintaining bills in a substantially flat, stacked position comprises a spring-loaded plate inside the inner housing positioned substantially parallel to the open face.

6. The bill accumulator system of claim 4 wherein the means for maintaining bills in a substantially flat position comprises a foam rubber piece inside the inner housing having a planar surface which is substantially parallel to the open face.

7. The bill accumulator system of claim 1 wherein the second actuating means further comprises key means for engaging the second locking means.

8. The bill accumulator system of claim 1 wherein the means for mounting the bill accumulator system onto a bill validator includes a mounting member for permanently mounting the second actuating means onto the bill validator.

9. The bill accumulator system of claim 1 wherein the means for mounting the bill accumulator system onto a bill validator includes a mounting slot in the outer housing of the bill validator adapted to receive a pivotal mounting shaft which is permanently connected to the bill validator.

10. The bill accumulator system of claim 1 wherein the first actuating means is securely mounted to an end of the outer housing and permanently engaged to a corresponding end of the inner housing.

11. A bill accumulator system for receiving and storing bills, comprising:

an outer housing having an opening for receiving bills from a bill validator, adapted to be mounted to a bill validator;

an inner housing having an opening for receiving and storing bills, rotatably mounted inside the outer housing;

first actuating means mounted to the outer housing and engaged to the inner housing for rotating the inner housing relative to the outer housing, comprising an inner locking means for selectively locking the inner housing in an open position for receiving bills in which the opening in the inner housing corresponds to the opening in the outer housing, and a closed position for blocking the passage of bills in which the opening in the inner housing faces away from the opening in the outer housing;

the inner locking means adapted to be engaged by a first key means;

the first actuating means adapted to be engaged by a second actuating means which is permanently mounted to the bill validator and which includes the first key means and a second locking means for selectively locking the second actuating means to the first actuating means as the inner housing is rotated to its open position, and for releasing the first actuating means from the second actuating means as the inner housing is rotated to its closed position.

12. A bill accumulator system for receiving and storing bills, comprising:

an outer housing having a substantially rectangular opening which is slightly longer and slightly narrower than the surface of a dollar bill;

an inner housing having a substantially rectangular opening which is slightly longer and slightly narrower than the surface of a dollar bill, rotatably mounted inside the outer housing;

first actuating means mounted to the outer housing and engaged to the inner housing for rotating the inner housing relative to the outer housing, comprising an inner locking means for selectively locking the inner housing in an open position in which the opening in the inner housing corresponds to the opening in the outer housing, and a closed position in which the opening in the inner housing faces away from the opening in the outer housing.

second actuating means engageable to the first actuating means for driving the first actuating means, comprising a first key means engageable to the inner locking means and a second locking means for selectively locking the second actuating means to the first actuating means as the inner housing is rotated to its open position, and for releasing the first actuating means from the second actuating means as the inner housing is rotated to its closed position;

key means for engaging the second locking means; and means for permanently mounting the second actuating means to a bill processing machine.

* * * * *

UNITED STATES PATENT AND TRADEMARK OFFICE

CERTIFICATE OF CORRECTION

PATENT NO. : 4,949,901

DATED : August 21, 1990

INVENTOR(S) : Robert R. Harris

It is certified that error appears in the above-identified patent and that said Letters Patent is hereby corrected as shown below:

In column 2, line 11, after "invention" please delete --,--.

In column 2, line 19, before the first occurrence of "the" please insert --into--; and before "inner" please delete --,--.

In column 2, line 22, after "FIG. 8" please insert --is--.

In column 2, line 25, after "invention," please insert --illustrating--.

In column 2, line 30, after "FIG. 11" please insert --is--.

Signed and Sealed this

Eighth Day of September, 1992

*Attest:*

DOUGLAS B. COMER

*Attesting Officer*

*Acting Commissioner of Patents and Trademarks*